US007503300B2

(12) United States Patent
Seitz et al.

(10) Patent No.: US 7,503,300 B2
(45) Date of Patent: Mar. 17, 2009

(54) SWITCHABLE ROCKER ARM OF A VALVE DRIVE PERTAINING TO AN INTERNAL COMBUSTION ENGINE

(75) Inventors: Joachim Seitz, Frensdorf (DE); Bodo Rörig, Weisendorf (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/816,466

(22) PCT Filed: Jan. 25, 2006

(86) PCT No.: PCT/EP2006/000621

§ 371 (c)(1),
(2), (4) Date: Nov. 5, 2007

(87) PCT Pub. No.: WO2006/087076

PCT Pub. Date: Aug. 24, 2006

(65) Prior Publication Data

US 2008/0264368 A1 Oct. 30, 2008

(30) Foreign Application Priority Data

Feb. 16, 2005 (DE) ..... 10 2005 006 954

(51) Int. Cl.
*F01L 1/18* (2006.01)

(52) U.S. Cl. ..... 123/90.39; 123/90.16; 123/90.44; 74/569

(58) Field of Classification Search ..... 123/90.16, 123/90.2, 90.39, 90.44, 90.45, 90.46, 90.48, 123/90.5, 90.52; 74/559, 567, 569
See application file for complete search history.

(56) References Cited

U.S. PATENT DOCUMENTS

| | | | | |
|---|---|---|---|---|
| 5,544,626 | A | 8/1996 | Diggs et al. | |
| 7,328,675 | B2 * | 2/2008 | Seitz et al. | 123/90.39 |
| 2003/0159669 | A1 | 8/2003 | Duesmann et al. | |

FOREIGN PATENT DOCUMENTS

| | | |
|---|---|---|
| DE | 19630309 | 1/1998 |
| DE | 10310220 | 9/2004 |
| DE | 10318295 | 11/2004 |
| EP | 1408203 | 4/2004 |
| WO | 2004083608 | 9/2004 |

* cited by examiner

*Primary Examiner*—Ching Chang
(74) *Attorney, Agent, or Firm*—Volpe and Koenig, P.C.

(57) ABSTRACT

A switchable finger lever (1) for a valve drive of an internal combustion engine is provided. The inner lever (3) of the finger lever includes a piston (6) on one end thereof, that can be longitudinally displaced, and acts as a coupling element. The coupling element can be partially brought into contact with a driving surface (7) of an outer lever (2), and is provided, for example, with a rising radial profile (13) in the coupling region thereof, and from the front (12) in the coupling direction. The driving surface (7) of the outer lever (2) also has a conical contour which follows the profile (13). During coupling, a contact point (K) of the piston (6) is located on the driving surface (7) in a region of half a depth thereof. In this way, the formation of undesired edge supports is prevented during coupling.

5 Claims, 2 Drawing Sheets

SWITCHABLE ROCKER ARM OF A VALVE DRIVE PERTAINING TO AN INTERNAL COMBUSTION ENGINE

BACKGROUND

The invention relates to a finger lever of a valve drive of an internal combustion engine, which can be switched to different lifts for at least one gas-exchange valve and which comprises an outer lever and an inner lever running between its arms and moving in a pivoting motion relative to this outer lever, with a borehole extending in the longitudinal direction of the lever being applied with a piston to one end of one of the levers, wherein this piston can be displaced with its top side in some sections under a driving surface of one end of the other respective lever, so that when coupled a large valve lift is generated, and when uncoupled a small or 0 valve lift is generated, wherein on the bottom side of the finger lever, a contact for a gas-exchange valve is provided on one end and a complementary surface for a support element is provided on the other end and wherein a force can be applied by at least one large lifting cam on a top side of at least the lever pivoting away in the decoupled case.

A finger lever defining this class is disclosed in DE 103 18 295 A1. Its piston extends as a coupling means in a borehole at one end of the inner element and can be displaced for the coupled case in some sections under a correspondingly shaped complementary driving surface of a crossbar of the outer lever.

The geometry of the coupling (convex in concave) and also production-specific inaccuracies or function-dependent play can lead to so-called "edge supports" during the operation of the cam follower in the coupled case. These are undesirable primarily because one inlet or outlet side edge of the driving surface becomes the main support surface when coupled. These elevated and undesired contact pressures can lead to an impact in the coupling area, so that, in turn, the play of the coupling is increased. However, this play must be held within tight tolerance limits, in order to guarantee proper functioning of the valve drive over its service life. Under some circumstances, the previously mentioned "edge supports" can also lead to the production of shavings, which can lead to the seizing of the respective piston.

SUMMARY

The object of the invention is to create a switchable finger lever of the previously mentioned type, in which the disadvantageous "edge supports" are eliminated with simple means.

According to the invention, this objective is met in that the piston is provided in its coupling region and also starting from its end lying in the coupling direction either with a rising, radial profile or with a falling, radial profile, wherein the driving surface of the other lever follows the profile with a conical-like shape and wherein when coupled a contact point of the piston lies on the driving surface in the region of half the depth of the driving surface.

Alternatively, this objective is met by the features of the associated claim 2, according to which the piston has a smooth cylindrical shape, and when coupled, its contact point on the driving surface lies in the region of half the depth of the driving surface and the driving surface, starting from the contact point, is provided on both sides with a falling, radial profile.

In this way, a switchable finger lever is presented, which no longer produces the "edge supports" noted above due to the radial profile according to the invention. Here, a contact point of the piston on the driving surface should lie approximately in the region of half the depth of the driving surface. Included in the protective scope of the invention, however, is also a solution, in which the contact point noted above is to be found at least not in the region of the edges of the complementary surface at their ends.

In this way, the measures according to the invention basically provide, in the coupling region, a point contact, which is still present after the beginning of the operation of the valve drive. Here, the design engineer is to observe a corresponding measure.

The radial profile provided on the piston can be generated, for example, by vibratory or belt grinding.

A simple formation of the driving surface is the subject matter of another dependent claim. Accordingly, this should be formed, for example, as a formation on a bottom side of a crossbar of the other respective lever, for example, the outer lever. However, it is also conceivable and provided to form the driving surface as a component of a borehole of a crossbar of the other respective lever.

According to another embodiment of the invention, the borehole with the piston is arranged in the inner lever above a complementary surface formed, for example, as a dome-shaped formation for the support element, and, in this way, to displace the piston for its coupled case longitudinally outwards under the corresponding driving surface.

Finally it is provided to produce the borehole for the piston in the inner lever as a through hole. This measure is especially favorable in terms of production.

The invention can be used definitely, but not exclusively, for finger levers with a "longitudinal locking" design. In the same way, the protective range also relates to switchable finger levers with so-called "cross locking" or to other switchable valve drive components, such as valve lifter drives, etc.

BRIEF DESCRIPTION OF THE DRAWINGS

The invention is explained in more detail with reference to the drawing. Shown are.

DETAILED DESCRIPTION OF THE PREFERRED EMBODIMENTS

Figure 1:
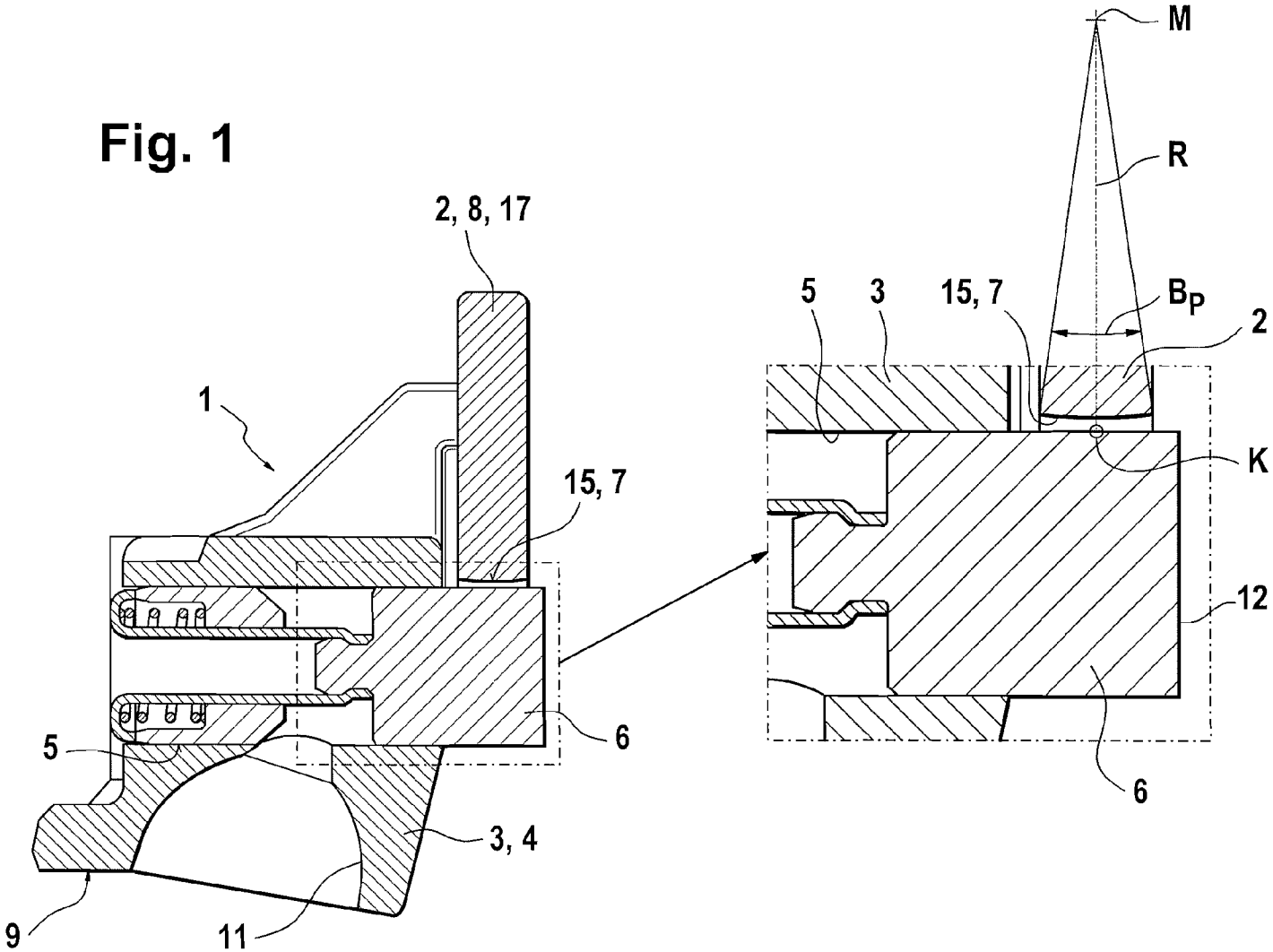
FIG. 1 the finger lever according to the invention in a partial longitudinal section view, with an enlarged section to show the coupling region, and FIGS. 2, 3 views showing variations of the profile of the piston used as the coupling means.

FIG. 1 discloses a switchable finger lever 1, as it is described by its basic setup in DE 103 18 295 A1 noted above (which is incorporated by reference). As another reference, at this point U.S. Pat. No. 5,544,626 is noted, in which, however, the piston extends in a borehole of the outer lever.

The finger lever 1 comprises an outer lever 2, between whose not-shown arms the inner lever 3 shown here merely in the region of its one end 4 is housed. The arms of the outer lever 2 are connected in the region of its one end 8 by a crossbar 17. Also to be seen is that in the region of the end 4 of the inner lever 3, a dome-shaped complementary surface 11 is applied to its bottom side 9. This is used as a support of the inner lever 3 and thus the entire finger lever 1 on a head of a support element not shown in the drawing.

A borehole 5 formed as a through hole runs in the inner lever 3 above the complementary surface 11. In the decoupled case, a piston 6 sits in this borehole as a coupling means. In all of the figures, the piston 6 is shown in its coupled position.

Here, with its outer surface it engages under a driving surface 7 of the crossbar 17 of the outer lever 2.

In the image on the right half of FIG. 1, the coupling region of the piston 6 is shown extracted and enlarged. According to the variants disclosed here, a smooth cylindrical piston 6 is provided. The coupled state is shown. Here, the driving surface 7, starting from the contact point K, is provided on both sides with a falling, radial profile 15. The contact point K lies approximately in the region of half of the depth or here at half the thickness of the crossbar 17 of the driving surface 7. Based on this profile according to the invention, the disadvantageous "edge supports" named above are no longer produced in the coupled case.

Figure 2:
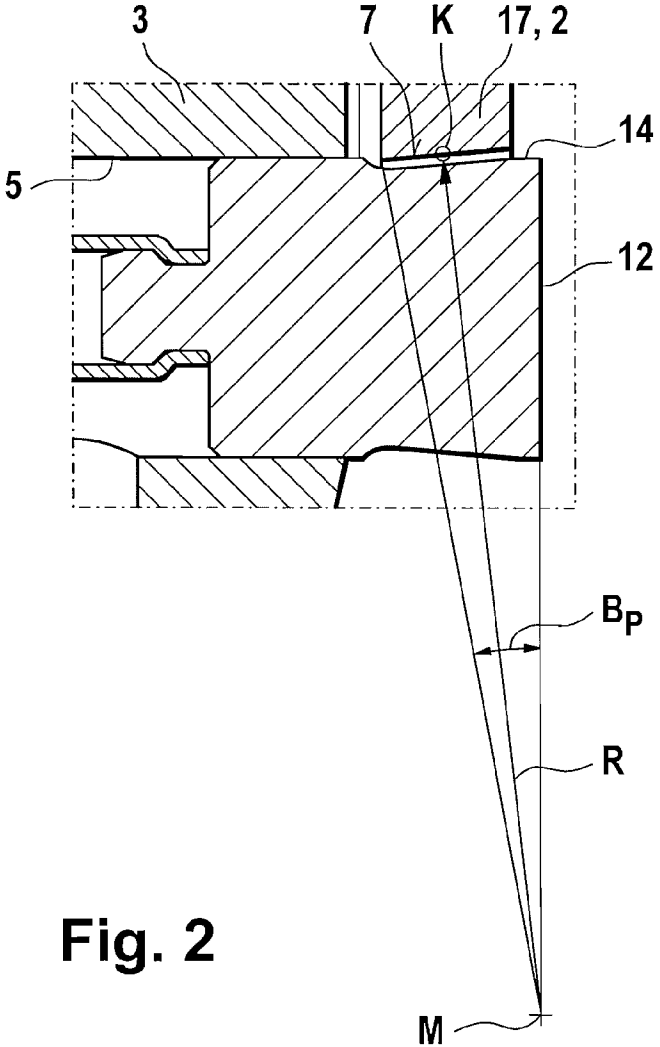

FIG. 2 discloses an alternative embodiment with respect to FIG. 1. Accordingly, the piston 6 has a falling, radial profile 14 in its coupling region. This begins from its end 12 lying in the coupling direction. Here, the region $B_P$ of the profile is drawn at least over the coupling section of the piston 6. Here, in all of the figures "R" stands for the radius of the profile and "M" stands for its center, which obviously can also lie at a different location. The driving surface 7 follows the profile 14 in an approximately conical-like shape. The contact point K here lies, in turn, in the region of half the depth of the driving surface 7.

Figure 3:
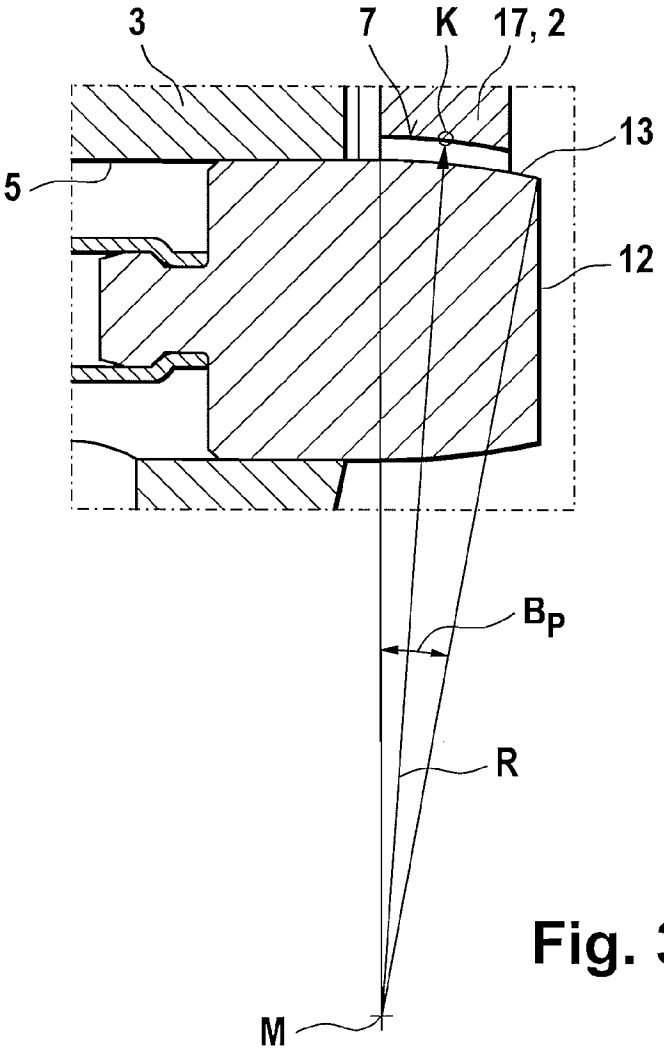

FIG. 3 shows a profile extending differently with respect to FIG. 2. Accordingly, the piston 6 has on its outer surface, starting from its outer end 12, a rising, radial profile 13. The driving surface 7, in turn, follows with a complementary conical-like shape.

If the driving surface 7 should be, for example, a borehole, such as a blind hole, then the term "half the depth" is related to the push-in region of the piston 6 when coupled.

LIST OF REFERENCE NUMBERS AND SYMBOLS

1) Finger Lever
2) Outer lever
3) Inner lever
4) End
5) Borehole
6) Piston
7) Driving surface
8) End
9) Bottom side
10) Not assigned
11) Complementary surface
12) End
13) Profile
14) Profile
15) Profile
16) Bottom side
17) Crossbar
M) Radius center
K) Contact point
$B_P$) Region of profile
R) Radius/perpendicular

The invention claimed is:

1. A finger lever of a valve drive of an internal combustion engine, which can be switched to different lifts for at least one gas-exchange valve, comprising an outer lever and an inner lever extending between arms of the outer lever and movable in a pivoting motion relative to the outer lever, wherein a borehole that extends in a longitudinal direction of the levers that includes a piston therein is located in one end of one of the levers wherein the piston can be displaced with a top side thereof having at least a portion located under a driving surface of one end of the other respective one of the levers, so that when coupled a large valve lift is generated and when decoupled a small or zero valve lift is generated, wherein on a bottom side of the finger lever a contact for a gas-exchange valve is located on one end and a complementary surface for a support element is located on an other end and wherein a force can be applied by at least one cam on a top side of at least the one of the levers that pivots away in a decoupled state, the piston is provided in a coupling region and also starting from an end thereof that extends in a coupling direction with a rising radial profile or with a falling radial profile the driving surface of the other lever is complementary to the profile with a corresponding shape, and when in a coupled state, a contact point of the piston lies on the driving surface in a region of half a depth of the driving surface.

2. The finger lever according to claim 1, wherein the piston has a smooth cylindrical shape, and in the coupled state, the contact point lies on the driving surface in the region of half the depth of the driving surface and wherein the driving surface is provided, starting from the contact point, on both sides with a falling, radial profile.

3. The finger lever according to claim 1, wherein the driving surface is provided either as formation on a bottom side of a crossbar or as a component of a borehole of a crossbar on the end of the other respective lever.

4. The finger lever according to claim 1, wherein the inner lever is provided with the contact for the gas-exchange valve and the complementary surface for the support element, and the borehole with the piston extends above or to a side of the complementary surface for the support element in the inner lever.

5. The finger lever according to claim 4, wherein the borehole for the piston is formed in the inner lever a through hole.

* * * * *